United States Patent [19]

Schips

[11] Patent Number: 5,052,317

[45] Date of Patent: Oct. 1, 1991

[54] APPARATUS FOR CUTTING STRIP-SHAPED SEWING MATERIAL

[76] Inventor: Helmut Schips, Klosterweidlistrasse 1, CH-9000 St. Gallen, Switzerland

[21] Appl. No.: 440,904

[22] Filed: Nov. 22, 1989

[30] Foreign Application Priority Data

Nov. 25, 1988 [CH] Switzerland ..... 4388/88

[51] Int. Cl.[5] ..... D05B 37/04

[52] U.S. Cl. ..... 112/130; 112/129; 83/613

[58] Field of Search ..... 112/125, 126, 128–130, 112/162, 288, 93, 297, 68, 122, 127; 83/613, 320–325

[56] References Cited

U.S. PATENT DOCUMENTS

| | | | |
|---|---|---|---|
| 1,065,941 | 7/1913 | Holtzmann | 112/130 |
| 4,281,607 | 8/1981 | Torre | 112/130 |
| 4,570,558 | 2/1986 | Hirayama et al. | 112/162 |

FOREIGN PATENT DOCUMENTS

3426283A1 1/1986 Fed. Rep. of Germany .

*Primary Examiner*—Werner H. Schroeder
*Assistant Examiner*—Sullivan C. Prak
*Attorney, Agent, or Firm*—Hubbard, Thurman, Tucker & Harris

[57] ABSTRACT

An apparatus for cutting strip-shaped sewing material on a sewing machine by means of power-operated cutters co-operating in scissor-like manner.

For enabling as well the separation of strips of materials that are hard to cut and for increasing the safely cuttable strip width in general, the invention proposes a cutting apparatus designed in the manner of a "guillotine". The apparatus is characterized by two cutter plates (1, 2) of equal size which are each formed with two cutting edges (1.1, 1.2; 2.1, 2.2) and which are disposed on a support (3) so as to be pressable against each other and at the same time linearly slidable in opposite directions with respect to each other.

10 Claims, 4 Drawing Sheets

N
1
1.2
B
F
1.1
2
2.1
2.2
A
G
1.6
1.6.2
4.2
1.6.3
4
4.1
5
5.1
3.2.1
3.2.2
1.5
3
3.1
3.3
3.2
6

APPARATUS FOR CUTTING STRIP-SHAPED SEWING MATERIAL

CROSS REFERENCE TO RELATED APPLICATIONS

This application claims priority under 35 U.S.C. §119 from Switzerland Application No. 4388/88-1 filed Nov. 25, 1988.

The invention relates to an apparatus for cutting strip-shaped sewing material on a sewing machine by means of power-operated cutters cooperating in scissor-like manner.

BACKGROUND OF THE INVENTION

1. Field of the Invention

For cutting sewing material of the type mentioned, cutting apparatus based on the principle of scissors have been used on sewing machines so far, with one cutter of said apparatus being pivotable about a fixed axis of rotation. Separation of strips or bands of materials that are hard to cut, such as rubber, with the aid of such scissors entails difficulties and often is impossible because of the instability of the pivotable cutter which increases as the distance from the axis of rotation increases. This instability in general presents a strong restriction to the safely cuttable width of strip-shaped sewing material.

SUMMARY OF THE INVENTION

It is the object of the invention to provide an apparatus of the type indicated at the outset, which avoids the disadvantages of known cutters or scissors and with the aid of which it is also possible to separate strip materials that are hard to cut.

Another object of the invention is an apparatus for cutting strip-shaped sewing material on a sewing machine by means of power-operated cutters cooperating in a scissor-like manner, having two cutter plates which are each formed with two cutting edges and which are disposed on a support so as to be pressable against each other and at the same time one plate is linearly slidable in opposite directions with respect to the other. The sliding cutter plate is supported with a rolling carriage to reduce friction during reciprocation.

The double-edged cutter plates cooperating in the manner of a "guillotine" permit during each relative movement thereof, irrespective of the direction of movement, a cutting operation to be carried out and, thus, allow doubling of the working speed of the cutting apparatus as compared to known apparatus of this kind. Because of the stability of the cutting apparatus, which is greatly increased at the same time, separation of strip-shaped sewing material that is hard to cut and/or has a considerably larger width is rendered possible as well. By providing two cutting edges on each cutter plate it is also possible to obtain a twice as long service life of the cutting apparatus, this fact constituting a considerable advantage with respect to servicing by sharpening the cutting edges. The cutting apparatus according to the invention also provides a space-saving solution with respect to its attachment to a sewing machine.

Features of a particularly advantageous development of the invention are indicated in the dependent patent claims 2 to 10. It can be taken in particular from patent claims 6 to 8 that the means for pressing the two cutter plates against each other are movable together with one of said plates, namely the slidable cutter plate. It is thus possible, in contrast to the known cutters, to achieve a cutting pressure during the cutting operation which remains constant along the entire strip width.

The cutter plates are initially supported by rollers for movement as the reciprocating cutter plate moves relative to the fixed cutter plate. In comparison with the strong sliding friction occurring between blades of known cutting apparatus, friction between the cutter plates is reduced; they are easier to move because of the rollers and consume less energy.

BRIEF DESCRIPTION OF THE DRAWING

The invention will now be elucidated in more detail by way of an example in the form of a preferred embodiment shown in the drawings.

DETAILED DESCRIPTION

Figure 1:
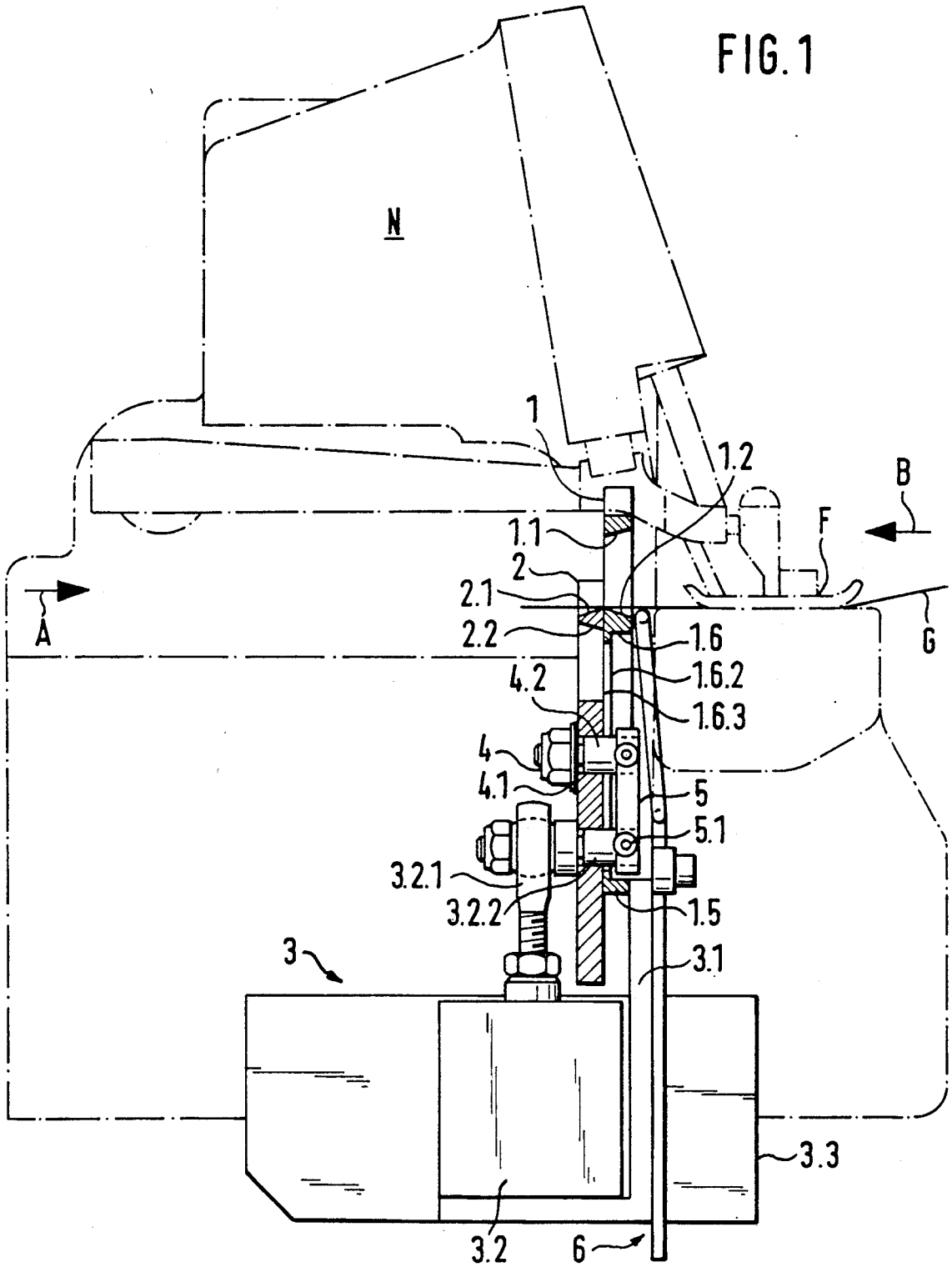
FIG. 1 shows a schematic side view of an apparatus according to the invention for cutting strip-shaped sewing material on a sewing machine for overlock-sewing that is outlined in fragmentary manner, with the arrow B indicating the direction of advance of the sewing material.

The cutting apparatus illustrated in FIG. 1 comprises two cutter plates 1 and 2 having substantially the same size. These plates are each formed with two cutting edges 1.1, 1.2 and 2.1, 2.2 and disposed on a support 3 so as to be pressable against each other and at the same time linearly slidable in opposite directions (see also FIGS. 2 and 3). The plates have a substantially rectangular configuration. Their arrangement on the support 3 is such that, after mounting of said support on the sewing machine N, they are disposed in a vertical position and at the same time are positioned transversely of the direction of sewing material advance as indicated by the arrow B (see FIG. 1). An exploded perspective view of the apparatus is seen in FIG. 4 with the parts identified by the same reference numerals as are used to identify the structure in the other Figures.

Figure 2:
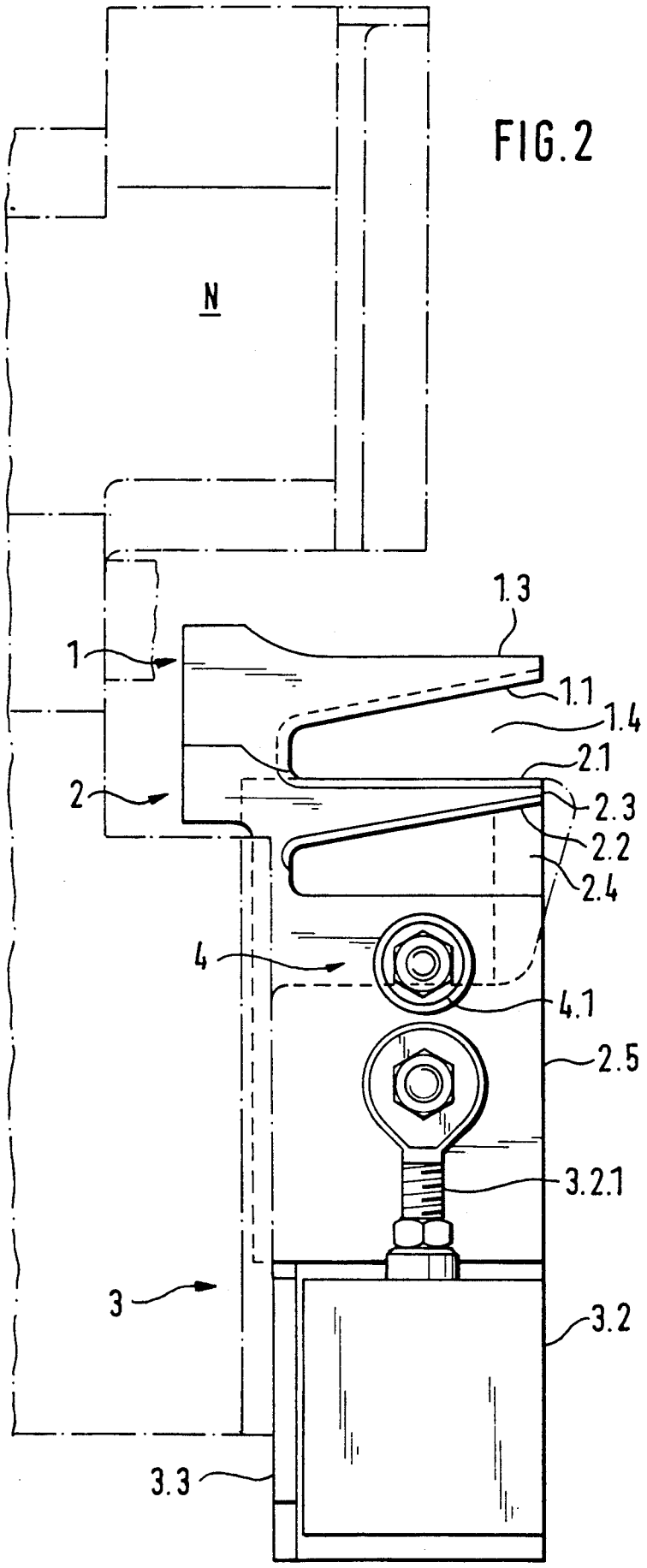
FIG. 2 shows a view of the two cutter plates of the cutting apparatus according to FIG. 1 as viewed in the direction of the arrow A in FIG. 1, opposite to the sewing material advance.

The cutter plates 1, 2 have, furthermore, on their upper ends, as viewed in said operational position, one beak-like projection 1.3, 2.3 each, which are each separated from the base part 1.5, 2.5 of the cutter plates 1,2 by a trapezoidal incision 1.4, 2.4 formed in said plates. The two cutting edges 1.1, 1.2 of the one cutter plate 1 are formed on the inclined lower edge of the beak-like projection 1.3 thereof and on the opposing horizontal edge of the trapezoidal incision 1.4 thereof. The other cutter plate 2 has its two cutting edges 2.1, 2.2 formed on the horizontal upper edge and the inclined lower edge of its beak-like projection 2.3. In FIG. 2, the cutting edge 1.2 of the cutter plate 1 is concealed by the cutting edge 2.1 of the cutter plate 2.

The support 3 of the cutting apparatus is composed of a carrier 3.1 supporting the cutter plates 1, 2, of a drive 3.2 secured to said carrier and actuating one of the two cutter plates 1, 2, namely the slidable cutter plate 2, and of a supporting plate 3.3 (see FIG. 1). The supporting plate 3.3 has the carrier 3.1 and the drive 3.2 anchored thereto in stationary manner, and it is adapted to be mounted to a sewing machine N. A pressure cylinder may be used as drive 3.2 in expedient manner. However, drives of different type could be used as well.

Figure 3:
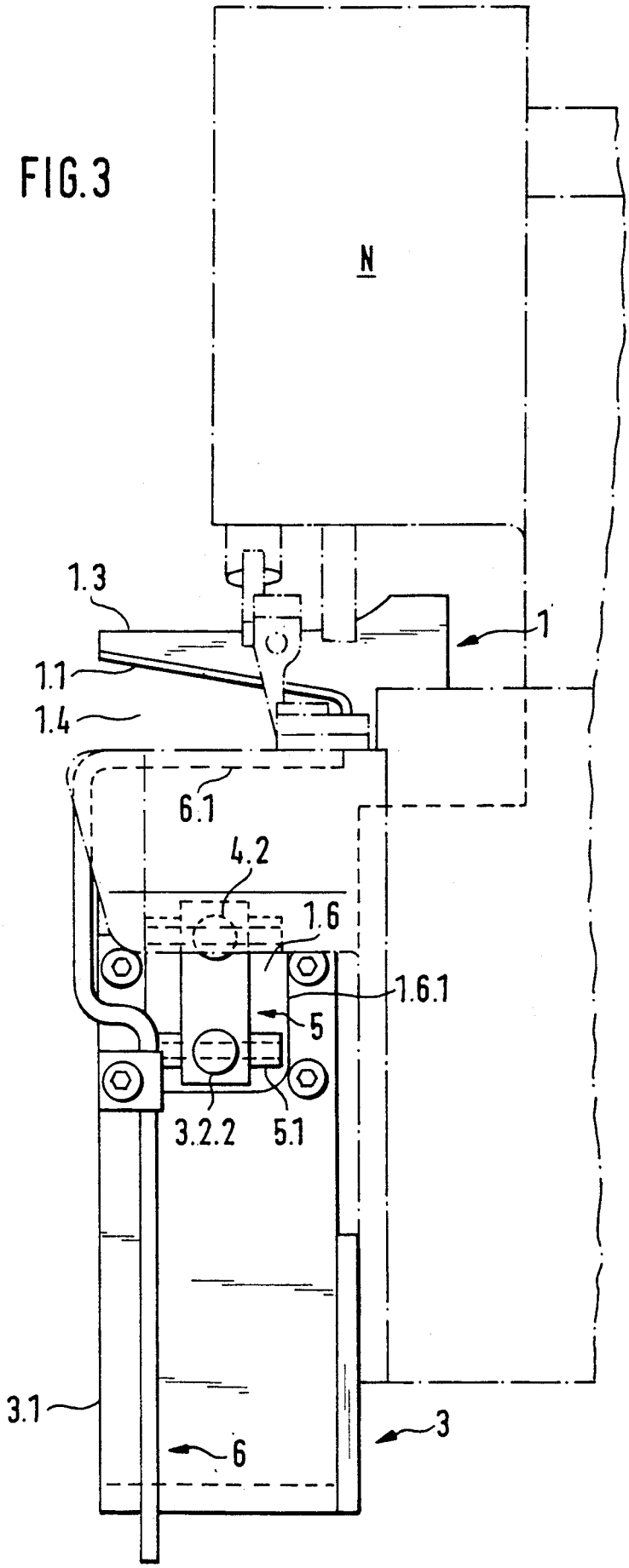
FIG. 3 shows a view of the two cutter plates of the cutting apparatus according to FIG. 1 as viewed in the direction of sewing material advance indicated by the arrow B in FIG. 1.
Figure 4:
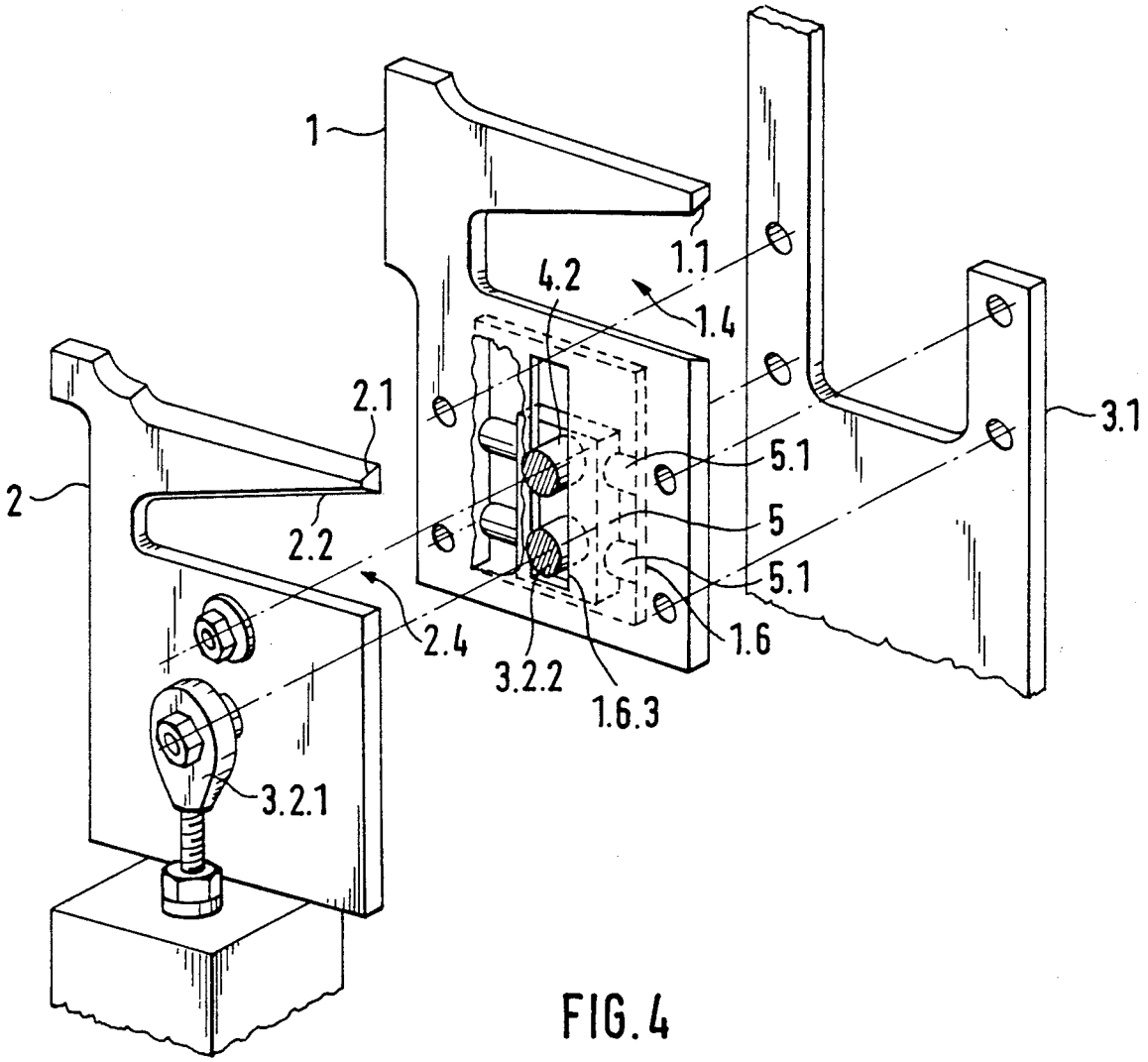
FIG. 4 shows the cutting mechanism in an exploded perspective view.

The association of the two cutter plates 1, 2 with respect to each other is such that during the upward stroke of the slidable cutter plate 2 the cutting edge 2.1 on the horizontal upper edge of the beak-like projection 2.3 thereof cooperates with the cutting edge 1.1 on the inclined lower edge of the beak-like projection 1.3 of the stationary cutter plate 1, and that during the downward stroke of the slidable cutter plate 2 the cutting edge 2.2 on the inclined lower edge of the beak-like projection 2.3 thereof cooperates with the cutting edge 1.2 on the horizontal edge of the trapezoidal incision 1.4 of the stationary cutter plate 1 (see especially FIGS. 2 and 3). The drawing illustrates the slidable cutter plate 2 in its lower end position.

For pressing the two cutter plates 1, 2 against each other during the cutting operation, a nut screw 4 together with a spring washer 4.1 (see FIG. 2) is provided on the face of the slidable cutter plate 2 facing away from the stationary cutter plate 1. This screw 4 cooperates, for adjusting the cutting pressure during the cutting operation, with one end of a screw bolt 4.2 extending through both cutter plates 1, 2, the other end thereof being guided in the stationary cutter plate 1 so as to be slidable together with the particular cutting operation. For achieving this, the face of the stationary cutter plate 1 facing away from the slidable cutter plate 2 is formed with a window-like recess 1.6 having longitudinal sides 1.6.1 extending vertically in the operational position of the cutting apparatus, and having in the center of the floor 1.6.2 thereof a slot 1.6.3 open parallel to the longitudinal sides 1.6.1 and serving for the screw bolt 4.2 producing the cutting pressure and for a further bolt 3.2.2. The latter forms part of the operational connection 3.2.1 of the slidable cutter plate 2 with the drive 3.2 thereof (see especially FIG. 1). As shown furthermore in FIG. 3, said two bolts 4.2 and 3.2.2 are threaded into a carriage 5 movable together with the slidable cutter plate 2 and being guidable by means of four rollers 5.1 on the floor 1.6.2 of said window-like recess 1.6 along the longitudinal sides 1.6.1 thereof. The recess 1.6, except for the slot 1.6.3, does not reach to the face of cutter plate 2 facing cutter plate 1. The above description of the construction of the cutting apparatus according to the invention clearly illustrates the advantageous mode of operation thereof. In particular one can see therefrom that during a cutting operation carried out with this apparatus a constant cutting pressure and, thus, a continuous cutting effect are ensured throughout the entire width of the strip-shaped sewing material to be cut, said sewing material being indicated by the letter G in FIG. 1. The stability of the cutter plates 1, 2, which is established by the concomitant sliding operation of the pressing member consisting of nut screw 4, spring washer 4.1 and screw bolt 4.2, permits cutting of strips of considerably greater width than possible heretofore without any problems.

For a better understanding of the invention, FIG. 1 schematically illustrates, furthermore, the sewing foot F of an overlock sewing machine N for holding down the material to be sewn, as well as outlines of additional parts of said sewing machine N.

For facilitating further transportation of the sewing material from the sewing machine N after the sewing operation, it is particularly advantageous to provide a pressure line 6 on the side of the stationary cutter plate 1 facing away from the slidable cutter plate 2, which supplies pressurized air to at least one nozzle 6.1 mounted in the vicinity of the trapezoidal incision 1.4 of the cutter plate 1.

For increasing the stability, it may be advisable in certain cases to connect the tips of the beak-like projections 1.3, 2.3 firmly to the respective base parts 1.5, 2.5 thereof by means of a strut.

Finally, FIG. 1 illustrates by way of the two arrows A and B the two views of the apparatus according to the invention as seen in FIGS. 2 and 3, respectively, the arrow B indicating at the same time the direction of sewing material advance.

I claim:

1. An apparatus for cutting strip-shaped sewing material on a sewing machine by means of a power-operated cutters cooperating in a scissor-like manner, characterized by two cutter plates (1, 2) which are each formed with two cutting edges (1.1, 1.2; 1.2, 2.2), each cutter plate having a base portion and an upper end portion, a beak-like projection at the upper end portion, and a trapezoidal recess opened at one side between the base portion and the beak like projection, one cutter plate (1) having one cutting edge (1.1) disposed on its beak like projection and the other cutting edge (1.2) disposed on its trapezoidal recess for cooperation with the cutting edges (2.1, 2.2) of the other cutter plate (2) having both cutter edges (2.1, 2.2) disposed on the beak like projection of said other cutter plate; the cutter plates (1,2) being disposed on a support (3) so as to be pressable against each other and at the same time said one cutter plate being linearly slidable in opposite directions with respect to said other cutter plate.

2. An apparatus according to claim 1, characterized in that the cutter plates (1,2) are received on the support (3) in such a manner that, after attachment of the latter to a sewing machine (N), they are disposed in a vertical position and at the same time oriented at right angles to the direction (B) of the sewing material advance.

3. An apparatus according to claim 1, characterized in that the two cutter plates (1,2) each have at their upper end, as seen when mounted in an upright vertical position, a beak-like projection (1.3, 2.3) that is separated from the base portion (1.5, 2.5) thereof by a trapezoidal recess (1.4, 2.4), said one cutter plate (1) having an inclined lower edge (1.1) of the beak-like projection (1.3) and an opposing horizontal edge (1.2) of the trapezoidal recess (1.4) of this cutter plate (1) formed as cutting edges (1.1, 1.2) and said other cutter plate (2) having a horizontal cutting edge (2.1) formed on the horizontal upper edge of its beak-like projection (2.3) and having inclined cutting edge (2.2) formed on the lower edge of its beak like projection (2.3) to form said cooperating cutting edges.

4. An apparatus according to claim 1, characterized in that the support (3) consists of a carrier (3.1) for supporting the two cutter plates (1, 2), a drive (3.2) that is also anchored to the carrier (3.1) and serves for actuation of one of the two cutter plates (1, 2), namely the slidable cutter plate (2), and of a supporting plate (3.3) having the carrier (3.1) and the drive (3.2) disposed thereon in stationary manner and being adapted to be mounted on a sewing machine (N).

5. An apparatus according to claim 3, characterized with the two cutter plates (1,2) having horizontal cutting edges (1.2, 2.1) so that when the two plates are vertically oriented and mated, during the upward stroke of the slidable cutter plate (2), the cutting edge (2.1) of the beak-like projection (2.3) thereof cooperates with the cutting edge (1.1) on the inclined lower edge of the beak-like projection (1.3) of the stationary cutter plate (1) and, during the downward stroke of the slidable cutter plate (2), the cutting edge (2.2) one the inclined lower edge of the beak-like projection (2.3) thereof cooperates with the cutting edge (1.2) on the horizontal edge of the trapezoidal recess (1.4) of the stationary cutter plate (1).

6. An apparatus according to claim 1, characterized in that the slideable cutter plate (2) has a face, facing away from the stationary cutter plate (1), having a nut screw (4) with a spring washer (4.1) provided thereon which, for adjustment of the cutting pressure under which the two cutter plates (1,2) are pressed against each other during the cutting operation, cooperates with one end of a screw bolt (4.2) extending through both cutter plates (1,2), the other end of said screw bolt (4.2) being supported by the stationary cutter plate (1) so as to be slidably movable relative to the stationary plate (1) during the cutting operation.

7. An apparatus according to claim 6, characterized by a window-like recess (1.6) having a floor formed in the face of the stationary cutter plate (1) facing away from the slidable cutter plate (2) and having longitudinal sides (1.6.1) extending vertically in the operational position, and having a slot (1.6.3) provided in the center of the floor (1.6.2) thereof parallel to the longitudinal sides (1.6.1) for the pressure-producing screw bolt (4.2) and for a further bolt (3.2.2) which forms part of the operational connection (3.2.1) between the slidable cutter plate (2) and the drive (3.2) thereof.

8. An apparatus according to claim 7, characterized in that the two bolts (3.2.2, 4.2) are received in a carriage (5) movable together with the slidable cutter plate (2) and, in doing so, guidable by means of four rollers (5.1) on the floor (1.6.2) of the window-like recess (1.6) along the longitudinal sides (1.6.1) thereof.

9. An apparatus according to claim 1, characterized in that the stationary cutter plate (1) has a face facing away from the slidable cutter plate (2), a pneumatic pressure line (6) being mounted on said face of the stationary cutter plate (1) and being connected to at least one nozzle (6.1) disposed in the vicinity of the trapezoidal recess (1.4) of said cutter plate (1).

10. An apparatus according to claim 1, characterized in that the tip of each beak-like projection (1.3, 2.3) is firmly connected to the base portion (1.5, 2.5) of the cutter plate (1, 2) via a strut each.

* * * * *